United States Patent [19]

Isaka et al.

[11] 4,440,486

[45] Apr. 3, 1984

[54] FIXING APPARATUS

[75] Inventors: Kazuo Isaka, Kawasaki; Fumitaka Kan, Tokyo, both of Japan

[73] Assignee: Canon Kabushiki Kaisha, Tokyo, Japan

[21] Appl. No.: 369,001

[22] Filed: Apr. 16, 1982

[30] Foreign Application Priority Data

| | | | |
|---|---|---|---|
| Apr. 20, 1981 | [JP] | Japan | 56-59469 |
| Nov. 21, 1981 | [JP] | Japan | 56-187445 |
| Nov. 21, 1981 | [JP] | Japan | 56-187446 |
| Feb. 26, 1982 | [JP] | Japan | 57-30247 |

[51] Int. Cl.[3] ..... G03G 15/00; G03G 15/20

[52] U.S. Cl. ..... 355/3 FU; 355/14 FU; 219/216; 219/388; 432/60; 432/228

[58] Field of Search ..... 355/14 FU, 3 FU, 3 R, 355/3 TR; 219/216, 388; 432/60, 61, 62, 228; 430/98, 99

[56] References Cited

U.S. PATENT DOCUMENTS

| | | | |
|---|---|---|---|
| 3,854,975 | 12/1974 | Brenneman et al. | 117/21 |
| 4,022,122 | 5/1977 | Moser et al. | 100/158 |
| 4,104,963 | 8/1978 | Fortmann | 100/76 |
| 4,154,575 | 5/1979 | Edwards et al. | 355/3 FU X |
| 4,188,109 | 2/1980 | Idenawa et al. | 355/3 FU |
| 4,200,389 | 4/1980 | Matsui et al. | 355/3 FU |
| 4,235,166 | 11/1980 | Tsunoi | 100/158 |
| 4,258,372 | 3/1981 | Ishikawa | 355/300 X |
| 4,341,458 | 7/1982 | Glasa et al. | 355/3 FU |
| 4,356,764 | 11/1982 | Haugen | 355/3 FU X |

*Primary Examiner*—A. C. Prescott

*Attorney, Agent, or Firm*—Fitzpatrick, Cella, Harper & Scinto

[57] ABSTRACT

The present invention relates to a fixing apparatus for use in electrophotographic copying machine or other image forming apparatus such as data recorder. More particularly, the present invention relates to a fixing apparatus of the type in which a toner image bearing member is pressed by a nip pressure between a pair of rotary members so as to fix the toner image onto the bearing member. The fixing apparatus of the present invention is characterized by the provision of limiting device for restraining the inter-axis distance between the two rotary members from increasing more than a predetermined value.

15 Claims, 25 Drawing Figures

FIXING APPARATUS

BACKGROUND OF THE INVENTION

1. Field of the Invention

The present invention relates to a fixing apparatus for use in image forming apparatus such as an electrophotographic copying machine and data recorder. More particularly, the present invention relates to such type of fixing apparatus wherein a nip pressure is applied to a toner image bearing member between a pair of rotating members so as to fix the toner image onto the bearing member.

2. Description of the Prior Art

In the art, there are known and used various types of fixing systems. They are generally classified into two groups, thermal fixing systems and pressure fixing systems. Examples of the former group are heat chamber systems, flash fixing systems and heating roller systems employing rotating members. A typical example of the latter systems is a pressure roller fixing system in which a pressure is applied by a pair of rollers.

According to the thermal fixing method, heat is applied to the toner image to fuse the toner and fix it to the image bearing member. The pressure fixing method uses a pair of rollers and the toner is fixed to the toner image bearing member by the nip pressure between the rollers. The pressure fixing method need not use heat and has an advantage in that there is no wait time as compared with the thermal fixing method. For example, in the case of heating roller system, the fixing apparatus can not be usable until the roller is warmed up to a necessary temperature. The time required for this warming up is mere wait time during which the apparatus is standing at rest. For pressure fixing systems such wait time is unnecessary. For this advantage, in these years, the pressure fixing system has attracted attention in the art.

However, the pressure fixing system involves some problems. Among them, irregularity of pressure is the most important problem. In the pressure fixing apparatus, the pressure application is done at the side plates by means of air pressure or spring pressure. If the transfer sheet (image bearing member) passes through between the pair of rollers in a position deviated from the symmetrical position with respect to the length of the rollers, then the rollers are somewhat inclined and therefore the nip pressure can no longer be applied uniformly to the transfer sheet. The pressure applied to the transfer material is higher than necessary at some part and lower at another part of the transfer material. Such irregularity of applied pressure results in poor image quality.

To solve the problem, there have been proposed and used some methods. One solution hitherto known is to apply a very high pressure to the whole image bearing member so as to obtain the necessary fixing pressure even at the lowest pressure portion. Another solution is to design the fixing apparatus in such manner that all image bearing members always pass through the middle of the roller no matter what different sizes the image bearing members may have. However, for the first mentioned solution, employing very large pressure, it is required to increase the durability and pressure resistance of the apparatus. This makes the apparatus large in size and heavy in weight. The latter mentioned solution also has some difficulties. After transferring the toner image to the image bearing member from the photosensitive medium, it is required to separate the image bearing member from the photosensitive medium with the aid of particular means such as corona discharger or gripper. Without such aid, it is difficult to convey the image bearing material correctly. Therefore, when the latter mentioned solution is used, it becomes very difficult to employ any simple separation method such as a separation belt system. These difficulties result in cost-up and complication of the apparatus.

For better understanding of the present invention, the problem involved in the prior art fixing system will be further described hereinafter with reference to FIG. 1.

FIG. 1A shows a pair of rollers used in the prior art pressure fixing apparatus. FIG. 1B shows the same pair of rollers with a sheet of image bearing member between the rollers by which a developed image is fixed on the sheet. FIG. 1C is a graph showing the distribution of pressure applied to the sheet.

In FIG. 1A, the two rollers R1 and R2 are pressed against each other by a known pressing mechanism (not shown). In the shown position, no fixing is being carried out and the two rollers are in contact with each other under a constant pressure. Therefore, in this position, the distribution of the nip pressure is uniform. In FIG. 1B, P is a sheet of transfer material which is now passing through the nip between the rollers R1 and R2 for fixing. At both ends of the rollers R1, R2 a load (pressure) W1 is being applied to the rollers. The transfer sheet P between the rollers R1 and R2 is deviated from the symmetrical position with respect to the axial direction of the roller. As the center line of the transfer sheet is not in alignment with the middle of the nip width between R1 and R2, the upper roller R1 is somehow inclined as seen in FIG. 1B. By this inclination of the roller, at the axial middle area of the roller, an excessively large pressure is applied to the sheet P. On the contrary, at the axially end area of the roller toward which the sheet is deviated from the center, the roller R1 becomes raised and the pressure applied to the sheet P is less than the necessary fixing pressure. Therefore, in this area, the toner image is insufficiently fixed. Such irregularity of applied pressure to the sheet P is seen best from the pressure distribution curve in FIG. 1C.

The present invention has solved the problem in a very simple manner. With the fixing apparatus according to the invention, the fixing pressure is applied always uniformly to all parts of the image bearing member.

SUMMARY OF THE INVENTION

Accordingly, it is an object of the invention to provide a fixing apparatus which can apply a uniform pressure to a toner image bearing member for fixing.

It is another object of the invention to provide a fixing apparatus which enables reduction of the size and weight of the apparatus.

To attain the above objects according to the invention there is provided such type of fixing apparatus in which a nip pressure is applied to a toner image bearing member by rotary members so as to fix the toner image onto the bearing member, said fixing apparatus being characterized in that it includes first and second rotary members between which the toner image bearing member is pressed by the nip pressure and limiting means for restraining the inter-axis distance between said two rotary members from increasing more than a predetermined value.

Owing to the above features of the invention, a uniform pressure can be applied to the toner image bearing member. The fixed images obtained from the fixing apparatus of the invention are sharp and clear without any irregularity of fixing.

Other and further objects, features and advantages of the invention will appear more fully from the following description of preferred embodiment with reference to the accompanying drawings.

DESCRIPTION OF THE PREFERRED EMBODIMENTS

Figure 1A:
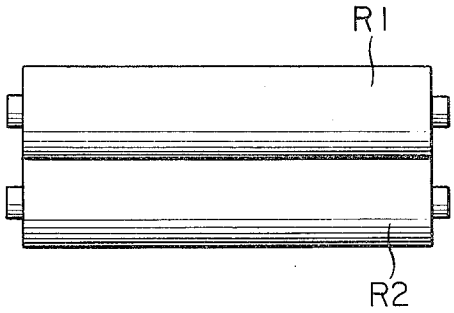
FIGS. 1A to 1C illustrate a fixing apparatus according to the prior art.
Figure 1B:
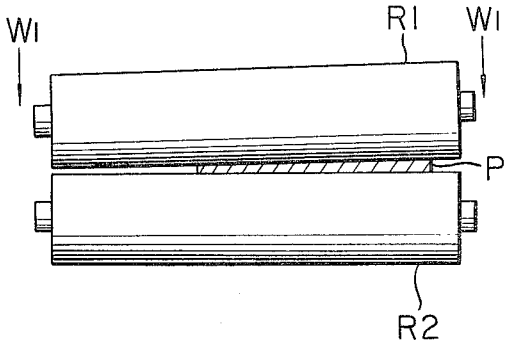
Figure 1C:
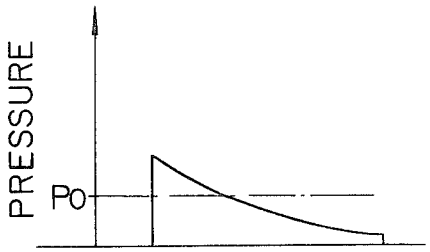
Figure 2:
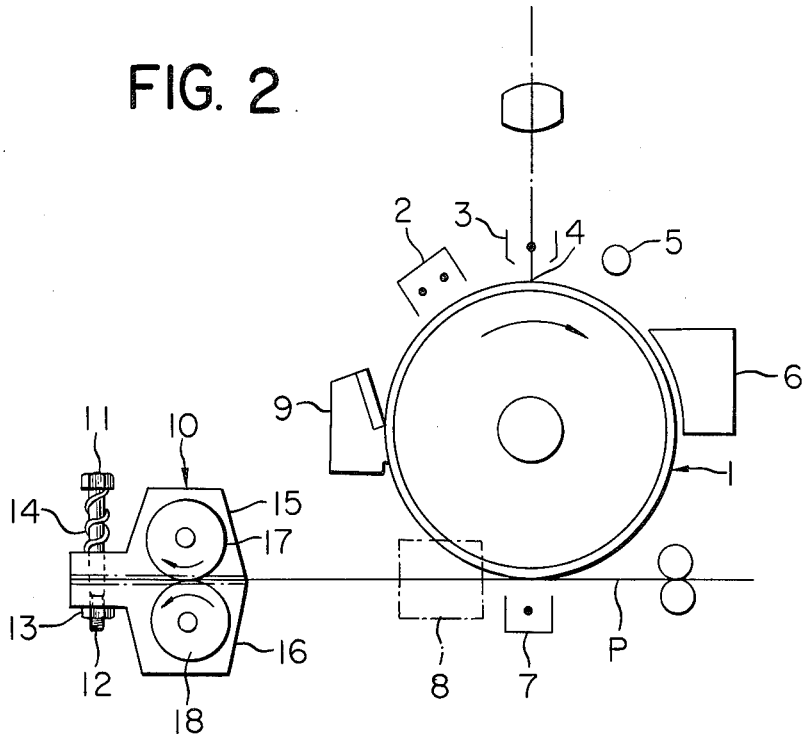
FIG. 2 is a schematic view of a copying machine to which the fixing apparatus of the present invention is applicable.

Referring first to FIG. 2 there is schematically shown an example of electrophotographic copying machines to which the present invention is applicable.

In FIG. 2, reference numeral 1 depicts a known photosensitive medium having a photoconductive layer and an insulating layer on the surface: 2 and 3 are chargers: 4 is an image exposure part: and 5 is a whole surface exposure lamp. Reference numeral 6 indicates a developing device: 7 is a transfer charger: 8 is separation means: 9 is a cleaner: and 10 is a fixing apparatus. The photosensitive medium 1 having a photoconductive layer and an insulating layer applied thereon is in a form of drum and is rotated in the direction of arrow. In the manner known per se, a latent image corresponding to the original image is formed on the drum surface with the use of chargers 2, 3, and by imagewise exposure at the image exposure part 4 and a whole surface exposure by the lamp 5. The latent image is developed by the developing device 6. By this development, there is formed a toner image on the photosensitive drum 1. The toner image is then transferred onto a transfer material P under the action of the transfer charger 7.

The transfer material P bearing the toner image thereon is separated from the drum 1 by separation means 8 and then introduced into the fixing apparatus 10. The toner image is fixed on the transfer material P by the fixing apparatus 10. Toner remaining on the drum 1 is cleaned off by the cleaner 9.

The latent image forming process described above is well known as the NP process. However, it is to be understood that the present invention is applicable to various types of image forming apparatus. The image forming process may be the Carlson process or other similar process. Also, it may be the EF process. Further, the photosensitive medium may be in the form of a belt. The image forming apparatus may be also operable according to the magnetic latent image forming method. The present invention can be applied to all of those apparatus which give toner image fixable onto an image bearing member P by means of pressure.

Figure 3A:
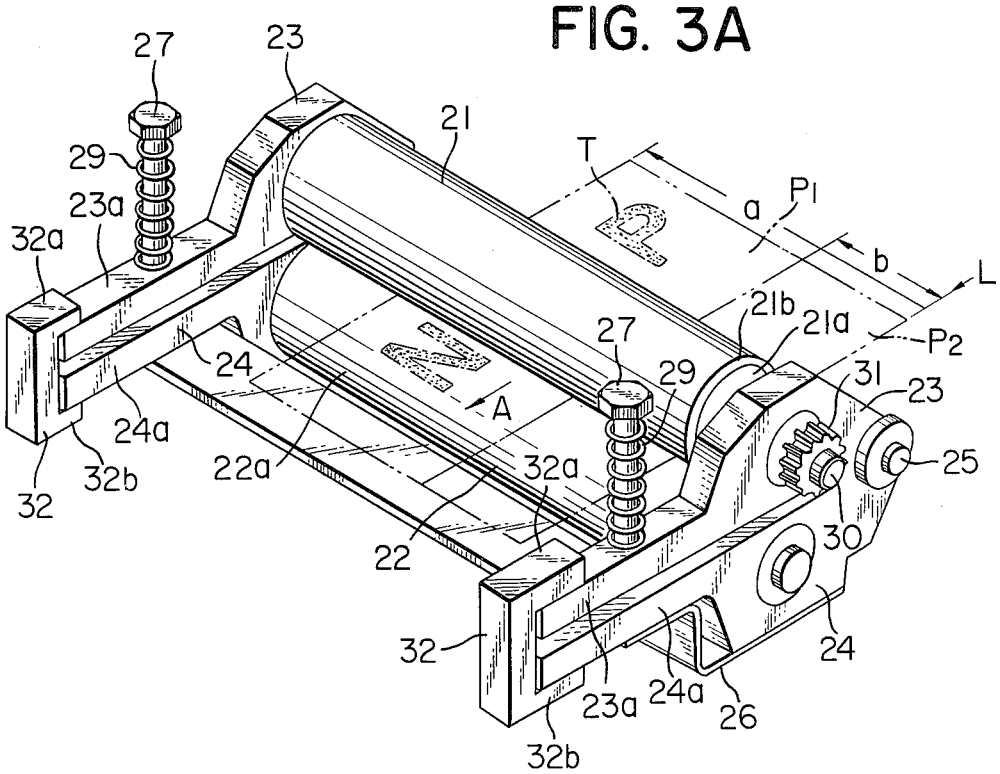
FIG. 3A is a perspective view of an embodiment of the fixing apparatus according to the invention.
Figure 3B:
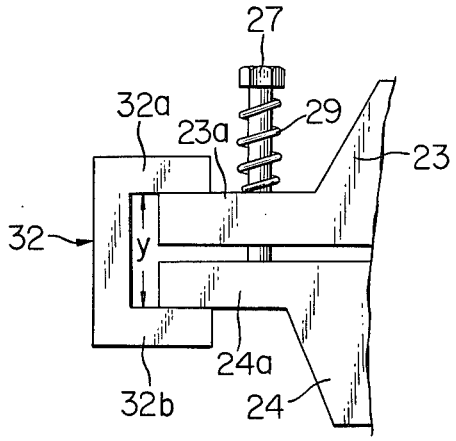
FIG. 3B is a side view of the essential part of the embodiment.

Now, a first embodiment of the invention will be described with reference to FIG. 3 in which FIG. 3A is a perspective view of the pressure fixing apparatus to which the present invention has been applied and FIG. 3B is a side view of the limiting member thereof.

In FIG. 3, the fixing apparatus includes a pair of rollers 21 and 22. The upper fixing roller 21 is made of a rigid metal body 11*a* covered with an elastic material 11*b*. The lower pressure roller 22 is made of a covered metal rigid body 22*a*. The metal material for the rigid body may be, for example, iron. The elastic material covering the rigid body may be, for example, plastics or rubber. Both ends of the upper roller 21 are supported by upper support members 23 and 23 and both ends of the lower roller 22 are supported by lower support member 24 and 24. These support members serve as journal bearings for rotatably receiving the end shaft parts of the upper and lower rollers 21 and 22 respectively. The upper and lower support members 23 and 24 at the right-hand side are connected by a shaft 25 at one end in such manner as to allow the upper and lower support members to be opened and closed about the shaft 25. Similarly, the upper and lower support members 23 and 24 at the left-hand side are joined by a shaft 25 for opening and closing about the shaft 25. A base plate 26 extends between the two lower support members 24 and 24. A bolt 27 is loosely received in a through-hole passing through the upper and lower support members at their free end parts. Two such bolts 27 are provided, one on the right-hand side and the other on the left-hand side, as viewed in the Figure. The lower free end of each the bolt 27 is fastened, for example, by means of nut (not shown). A compression spring 29 is disposed between the head of the bolt 27 and the upper support member 23. This compression spring is a pressing mechanism for forming a nip pressure between the rollers 21 and 22. By this pressing mechanism there is applied between the rollers 21 and 22 a pressure of about 600 to 1000 kg W. A gear 31 is fixedly mounted on the roller shaft 30 of the upper roller 21 to transmit the driving force to the upper roller from a driving source such as motor (not shown). By this driving force the upper roller 21 is driven into rotation and the lower roller 22 rotates following the upper roller.

In this embodiment, roller gap limiting means 32 constitutes an essential part of the invention, that is, limiting means for limiting the inter-axis distance between the upper and lower rollers 21 and 22. Said gap limiting means 32 keeps the gap size between the two rollers within a predetermined range thereby preventing the ends of the upper and lower roller support members 23 and 24 from being opened wider than a certain determined distance. Said gap limiting means 32 is in the form of " ⊐ " and made of a rigid material such as metal or hard plastics. Limiting means 32 is mounted on the ends of extensions 23*a*, 24*a* of the support members 23, 24 in the vicinity of the pressure mechanism. The extensions 23*a*, 24*a* of the support members are sanwiched in between the upper and lower legs 32*a* and 32*b* of the limiting member 32. The under side of the upper leg 32*a* is in loose contact with the upper side of the extension 23*a*. The lower leg 32*b* is removably connected with the extension 24*a* by means of screw or the like or it is firmly fixed to the extension by means of bonding agent or the like. In this arrangement, the opening distance between the upper and lower extensions 23*a* and 24*a* of the support members 23 and 24 is limited by the distance y between the upper and lower legs 32*a* and 32*b* as seen best in FIG. 3B. In other words, the free ends of the upper and lower roller support members 23 and 24 can not open wider than the leg distance y even when a transfer material is passing through between the upper and lower rollers 21 and 22. This prevents the inter-axis distance between the two rollers from being broadened by the transfer material beyond the determined limit.

As previously mentioned, the transfer material is pressed by the nip pressure between the upper and lower rollers 21 and 22 for fixing the toner image on the transfer material. The size of the transfer material is variable. Sometimes, its width may be a which is a little smaller than the width of the roller. Sometimes, it may be b which is smaller than the half width of the roller. The latter-mentioned small size transfer material may be conveyed to the nip between the rollers in a position not in alignment with the center of the length of the rollers (transfer material conveying means is not shown in the drawing). Even in any of such cases, the gap limiting member 32 assures uniform application of pressure to the toner image on the transter material. Therefore, always good fixing of toner image can be attained by this arrangement according to the invention.

Figure 3C:
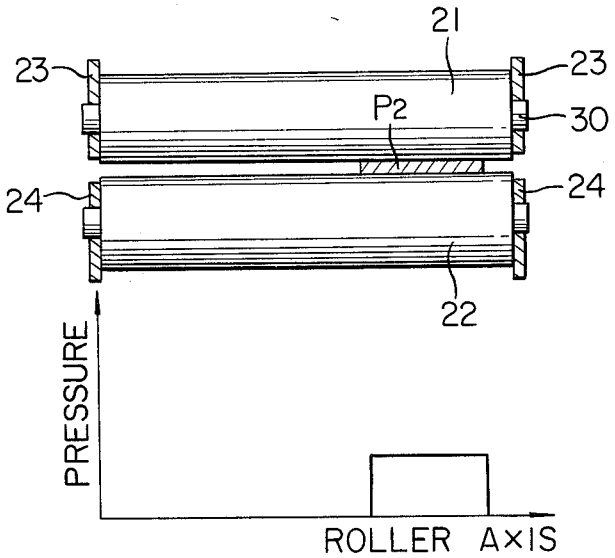
FIG. 3C is a side view thereof showing the pressure distribution.

FIG. 3C schematically shows the distribution of the nip pressure and the state of gap between the two rollers 21 and 22 obtained when a toner image T on a transfer material P2 was fixed by the nip pressure between the fixing rollers 21 and 22 in the above embodiment.

As seen from FIG. 3C, the upper roller 21 is subjected to almost no inclination at fixing. The pressure applied to the transfer material P2 is substantially uniform throughout the whole width of the transfer material.

While the limiting member 32 has been shown and described as having its one leg 32*b* fixed to the extension 24*a* and its other leg 32*a* loosely contacted by the extension 23*a*, it is also possible to provide a small gap between the leg 32*a* and the corresponding extension and between the leg 32*b* and the corresponding extension. The gap size may be determined suitably taking into account the thickness of transfer material (which is usually in the range of about 50 to 100$\mu$). What is necessary is to limit the increase of the roller gap caused by the inserted transfer material within an allowable range for obtaining the necessary fixing pressure.

Limiting means 32 may be mounted in another position than that shown in FIG. 3A. The mounting position can be selected from many positions where the load on limiting means is small and the gap control by limiting means can be attained easily. It is not always necessary to provide such limiting means on both sides of the rollers. It may be provided only on one side which is the same side as the area in which the transfer material passes. Also, limiting means may be provided not on the roller support member but on a stationary member of the main body of apparatus (not shown).

When transfer materials having different thickness and different width are used in the same apparatus, the purpose of uniform distribution of pressure applied to the transfer material can be attained by suitably adjusting the distance y between the upper and lower legs of the limiting member of suitably exchanging the limiting member between differently sized limiting members.

Figure 4:
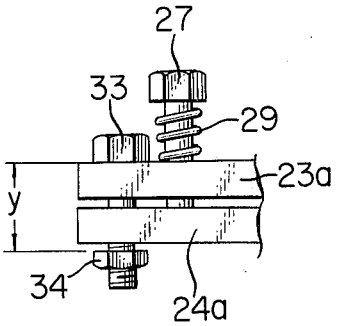
FIG. 4 shows a second embodiment of the invention.

FIG. 4 shows such embodiment in which the leg distance y of lmiting means is adjustable.

In this embodiment, limiting means includes a bolt 33 and a nut 34. The bolt 33 is inserted into a through-hole passing through the extensions 23*a* and 24*a*. The lower end of the bolt 33 is screwed in the nut 34. By adjusting the nut 34 the distance y can be adjusted as desired.

Figure 5:
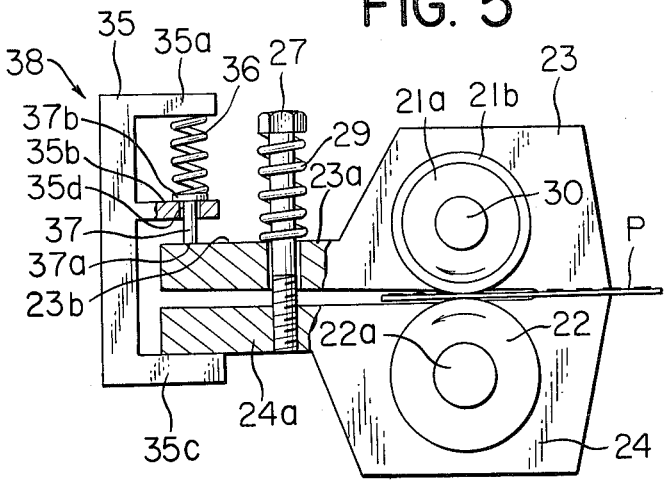
FIG. 5 shows a third embodiment of the invention.

FIG. 5 shows another emboidment of limiting means.

In this embodiment, limiting means 38 includes a gap limiting member 35 and a spring 36. The gap limiting member 35 is in the form of " ∃ " and the compression spring 36 is disposed between the upper leg 35*a* and middle leg 35*b* of the limiting member 35. The middle leg 35*b* has a through-hole 35*d* which a pin 37 passes through. The lower end 37*a* of the pin 37 is spaced above from the upper side of the extension 23*a*. The compression spring 36 elastically pushes the pin 37 downwards. The head 37*b* of the pin determines the position of the lower end 37*a* of the pin under the action of the compression spring 36 which is in the compressed state between the upper and middle legs 35*a* and 35*b*. The free end parts of the extensions 23*a* and 24*a* are held between the pin 37 and the lower leg 35*c* of the limiting member 35 to limit the opening of the roller support members 23 and 24.

When a transfer material enters the nip between the upper and lower rollers 21 and 22, the upper roller 21 is displaced upward by the transfer sheet. However, the gap between the rollers 21 and 22 can not be widened over a predetermined limit because the limiting member prevents it. When the gap is widened more than a determined value, the upper side 23*b* of the extension 23*a* comes into contact with the lower end 37*a* of the pin 37 and tends to push up the pin against the spring force of the compression spring 36. Therefore, an increasing pressure is applied to the extension 23*a* by the compression spring. Thus, the limiting member prevents the upper roller 21 from being excessively displaced upwardly at its one end part of the roller length. In this embodiment, it is desirable that the spring 36 for limiting the increase of the roller gap should have a larger spring rate than the spring 29 of the pressing mechanism and/or that the spring 36 should be in the state pressed by the legs 35*a* and 35*b* even when no transfer material exists between the rollers 21 and 22.

Like the first embodiment, this embodiment effectively prevents the inter-axis distance between rollers 21 and 22 from being increased more than a predetermined value at fixing. Therefore, even when a transfer material P of smaller size in width passes through the roller nip in an asymmetrical position with respect to the axial length of the rollers, the upper roller can not be excessively inclined and there can be obtained substantially uniform distribution of applied pressure to the transfer material in the axial direction of the rollers.

In addition, this embodiment has a particular advantage that since there is used an elastic member as limiting means, changes in irregularity of the pressure distribution for different transfer materials having different thickness and width can be accommodated by it. This makes it possible to use various kinds of transfer materials. Further, said elastic limiting means has an effect to absorb the shock applied by the transfer material when it enters the nip between the rollers 21 and 22.

Figure 6A:
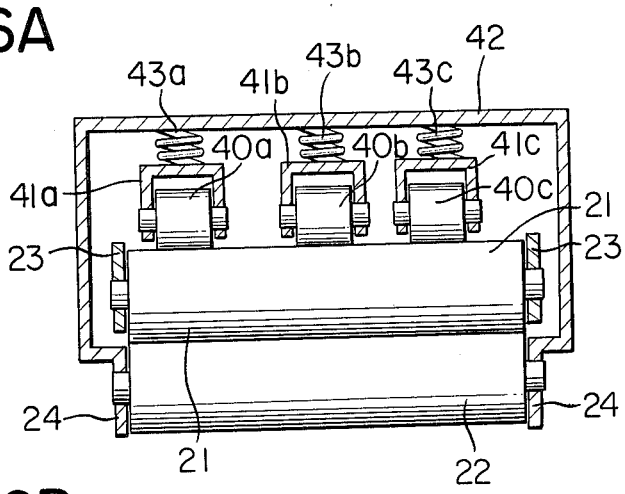
FIGS. 6A and 6B show another embodiment of the invention.

FIG. 6A shows a further embodiment of the present invention.

In this embodiment, the roller gap limiting part serves also as a nip pressure application mechanism.

This embodiment includes two or more pressure rollers 40*a*, 40*b*, 40*c* arranged in parallel to each other within the axial width of the fixing rollers 21, 22. These pressure rollers 40*a*, 40*b*, 40*c* are so disposed as to directly and rotatably contact with the upper fixing roller 21 at regular axial intervals. The respective pressure rollers are operable independently each other to independently apply a pressure to the fixing roller. In the shown embodiment, the individual pressure rollers 40*a*, 40*b*, 40*c* are rotatably supported by their own frame members 41*a*, 41*b*, 41*c* respectively. These frame members are supported by a common frame 42 formed integral with the lower roller bearing member 24. Between the common frame 42 and the individual frame members 41*a*, 41*b*, 41*c* there are disposed springs 43*a*, 43*b*, 43*c* respectively. By these springs the pressure rollers 40*a*, 40*b*, 40*c* are pressed down against the upper roller 21 thereby forming a nip pressure between the fixing rollers 21 and 22.

In this embodiment, since the pressure rollers 40*a*, 40*b*, 40*c* can independently act on the fixing roller, the excessive lift of the upper roller 21 and therefore the excessive increase of the nip gap between the rollers 21 and 22 at fixing can be restrained very effectively. According to the width size of the transfer material entering the nip, one or two of the pressure rollers act on the fixing roller 21 at the portion where the roller is shifted by the transfer material. The pressure roller or rollers apply a pressure to the shifted portion to prevent the roller nip from being excessively widened. Since the inter-axis distance between the fixing rollers 21 and 22 is kept within a determined allowable range in this manner, the fixing roller is prevented from inclination and always uniform pressure can be applied to the transfer material. Further, since the pressing member is divided into plural pressure rollers, there is no problem of flex of roller which is caused when the fixing pressure is applied to the roller at two ends of the roller as in the conventional apparatus. Therefore, uniformity of the applied pressure to the transfer material is further improved by this embodiment.

Figure 6B:
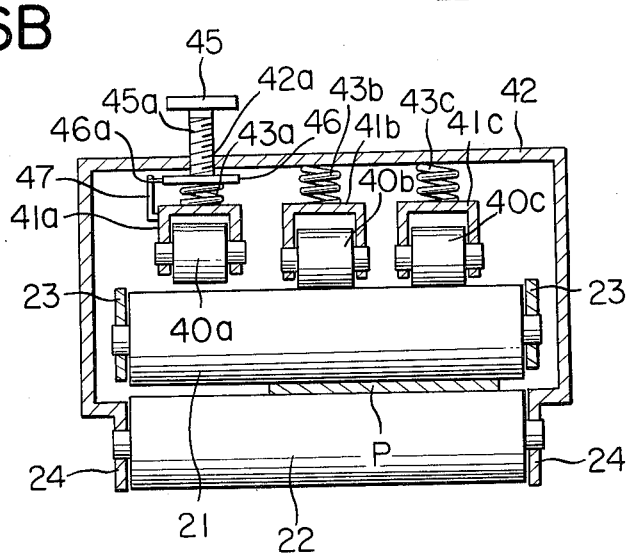

FIG. 6B shows a modification of the above shown embodiment. In the modification, the pressure roller 40*a* can be moved up and down to depart from the roller and contact it. To this end, a hole 42*a* having a female thread is provided in the common frame 42. A handle 45 having a mating male thread 45*a* is screwed in the hole 42*a*. The lower end has a holding plate 46 on which the spring 43*a* is fixed. By turning the handle 45, the holding plate 46 is moved up or down and therefore the pressure roller 40*a* is moved up or down through the spring 43*a*. In this manner, the pressure roller 40*a* can be moved away from the fixing roller 21 or toward the roller as desired. When the pressure roller 40*a* is moved up away from the fixing roller 21, a hook 47 turnably mounted on the frame member 41*a* is engaged with a dowel 46*a* provided on the holding plate 46 to limit the action of the spring 43*a*.

As shown in FIG. 6B, when the transfer material is of small width, the pressure roller 40*a* is moved up away from the fixing roller 21 and only the necessary number of pressure rollers (in case of the shown example, only the pressure roller 40*b* and 40*c* are necessary for fixing) act on the fixing roller 21 to apply the necessary nip pressure to the transfer material between the fixing rollers 21 and 22. This arrangement accommodates the applied pressure to the change of width and thickness of the transfer material very well. Therefore, fixing can be accomplished with always uniform distribution of pressure for all of different transfer materials having different width and thickness. The problem of inclination of the fixing roller can be eliminated almost completely by this arrangement. Also, since one pressing roller divided into plural pressure rollers movable up and down relative to the fixing roller in this manner, it is possible to reduce the total pressure applied to one and single roller. This prevents application of unduely large pressure between the two fixing rollers.

Figure 7:
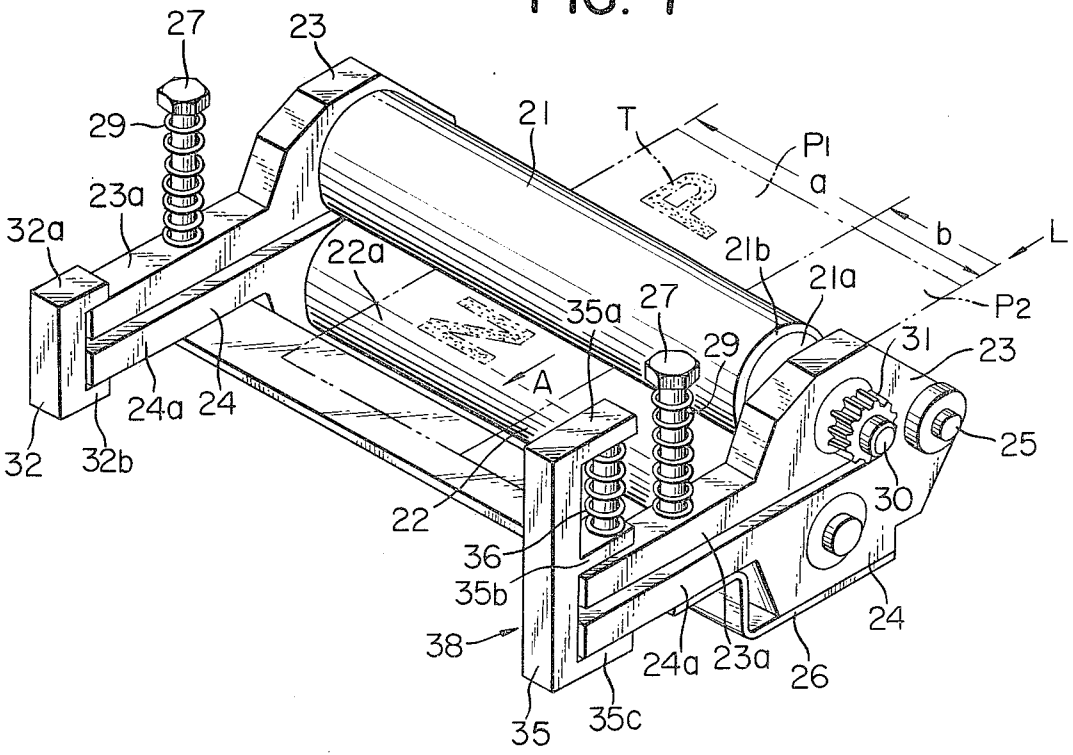
FIGS. 7 and 8 are perspective views showing a further embodiment of the invention.

FIG. 7 shows a further embodiment of the invention. This embodiment is a combination of FIG. 3 embodiment and FIG. 5 embodiment.

In FIG. 7, L indicates the guide line along which the transfer material P1 or P2 is to be conveyed. In this embodiment, the limiting member 32 on the side remote from the guide line L is formed of a rigid material as shown in FIG. 3. The limiting member 38 on the side near the guide line L is a limiting member having a spring 36 as shown in FIG. 5. With this arrangement, the excessive widening of the gap between two rollers 21 and 22 can be prevented much more surely and completely. Further, the use of spring 36 serves to damper the flex of the roller.

While the above embodiments have been shown to use a roller covered with an elastic layer as the upper fixing roller and a metal roller as the lower fixing roller, it is to be understood that other fixing rollers also can be used in the invention. The upper and lower fixing rollers both may be rigid metal rollers (for example, steel roller plated with chrome). By applying an elastic layer to at least one of the rollers there can be obtained additional functions, for example, to absorb the shock caused by the insertion of a transfer material between the rollers and to prevent any fixing irregularity attributable to the surface roughness of the transfer material. Use of a rigid roller as the upper fixing roller brings forth an advantage of less offset. provision of an elastic layer on the upper roller has an advantage of improved uniformity in fixing.

Figure 8:
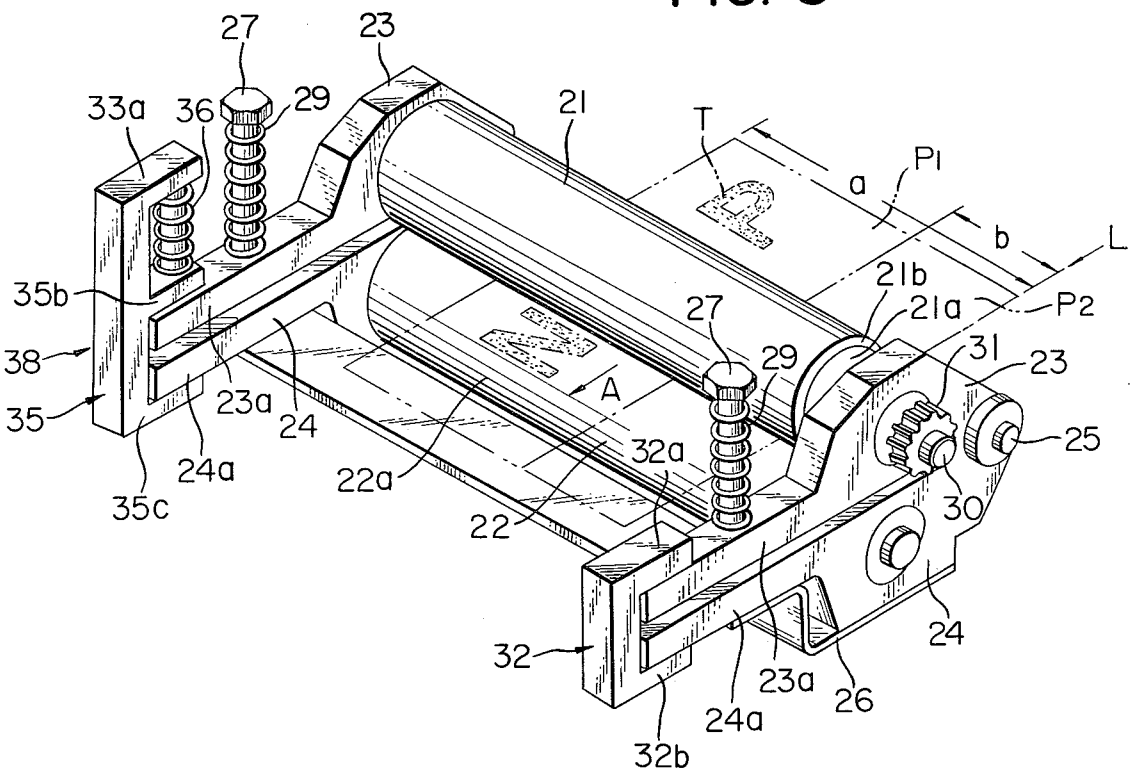

FIG. 8 shows still a further embodiment of the invention. In this embodiment, the limiting member 38 having an additional spring 38 as previously described is used on the side remote from the guide line L for one-sided moving transfer material P1 or P2. On the side near the guide line L there is used a rigid limiting member 32. This arrangement has an advantage that the rollers 21 and 22 can be prevented more surely and completely from being excessively broadened by the transfer sheet entering the nip and also the spring 36 damps the reaction to any abrupt inclination change of the roller.

Another embodiment of the invention will be described with reference to FIGS. 9A to 9C.

Figure 9B:
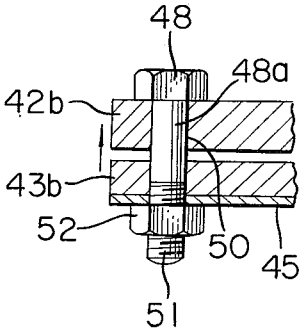
FIGS. 9B and 9C are sectional views of the essential part thereof.
Figure 9C:
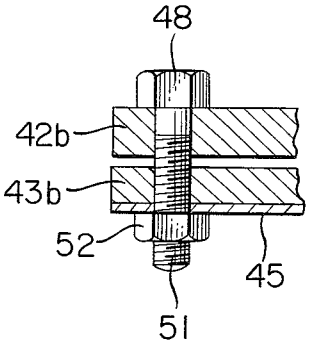
Figure 9A:
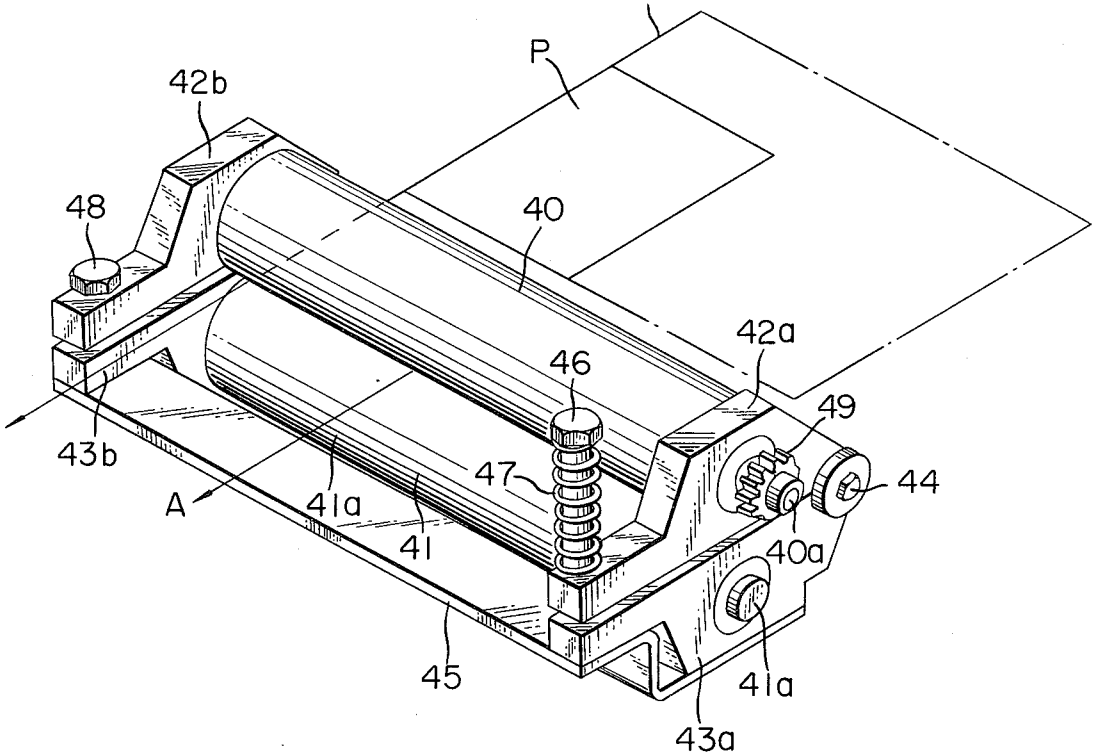
FIG. 9A is a perspective view of a still further embodiment of the invention.

In FIG. 9A, 46 is a rigid fixing roller made of metal for example. A pressure roller 41 has an elastic surface layer 41*a*. Upper and lower support members 42*a*, 42*b* and 43*a*, 43*b* support the upper roller 40 and the lower roller 41. The arrangement and function of these support members correspond to those of the support members previously shown in FIG. 3. By a shaft 44 the upper support member 42*a* and lower support member 42*b* (also 43*a* and 43*b*) are joined at one end for opening and closing about the shaft 44. A connection plate 45 is between the lower support members 43*a* and 43*b*. A bolt 46 is at the free end part of the support member 42*a*. The bolt 46 passes through a through-hole provided at the free end part of the support member. Between the bolt and the through-hole there is provided a small clearance. The lower end part of the bolt 46 is screwed in the lower support member 43*a* (or the bolt is inserted into a through-hole in the lower support member). A nut is fitted on the end of the bolt. Between the head of the bolt 46 and the upper support member 42*a* there is disposed a compression spring 47 having a spring constant K.

On the opposite side to the above bolt 46, there is provided a bolt 48 which is shorter than the bolt 46. The bolt 48 passes through the free end parts of the upper and lower support members 42*b* and 43*b* in the same manner as above. Also, a nut is fitted on the end of the bolt 48. The side on which the shorter bolt 48 is provided is the side near the guide line L for one-sided guidance of transfer material P. A further detailed description of the smaller bolt 48 will be made later with reference to FIGS. 9B and C.

A transfer material P bearing thereon a toner image comes in the nip between the rollers 40 and 41 along the guide line L. A driving force is transmitted to the upper roller 40 from a driven source such as motor through a gear 49 mounted on the roller shaft 40*a*. By this driving force, the upper roller 40 is driven into rotation. The lower roller 41 rotates following the rotation of the upper roller 40. The toner image on the transfer material P is fixed by the nip pressure between the upper and lower rollers 40 and 41 while moving the transfer material P in the direction of arrow A. Reference numeral 41*a* is the roller shaft of the lower roller 41. With this arrangement, the bolts 46, 48 and the spring 47 prevent irregularity of fixing pressure applied to the transfer material. Therefore, always good fixation can be attained for different image bearing members having different size, thickness and material quality.

Referring to FIG. 9B, the upper and lower support members 42*b* and 43*b* and the connection plate 45 have a through-hole 50 whose diameter is a little larger than the outer diameter of the shank part 48*a* of the bolt 48. The shank part of the bolt 48 is inserted into the through-hole 50. The lower end part of the bolt 48 has a male thread 51 engageable with an inner female thread of the nut 52. Bt screwing the threaded end part of the bolt 48 in the nut 52, the bolt 58 is fixed to the support members 42*b*, 43*b* and connection plate 45. In this fixed position, the connection plate 45 is in press-contact with the underside surface of the lower support member 43*b*. At least during fixing the bolt 48 should be in the position fastened by the nut 52. However, when fixing is not being carried out, the bolt may be unfastened (in this case it is preferable to make the through-hole have an allowance for movement of the bolt).

FIG. 9C shows an modification of the embodiment shown in FIG. 9B.

In this modification, the through-hole in the support member 43*b* has a female thread. The hole in the support member 42*b* is a simple through-hole without thread. Therefore, the bolt 48 has a sufficiently long threaded part 51 enough to reach the support member 42*b*. As the male thread in the threaded shank part and the female thread in the support member 43*b* engage each other, the support member 43*b* remains always fixed. More preferable, there is used a longer bolt having a larger male thread part than that shown in FIG. 9C. Further, a loose-check processing is carried out so as to assure a firmer thread engagement between the bolt 48 and the support members 42*b*, 43*b*. By doing so, a better effect can be obtained to hold the support members fixed even at the entrance of transfer material into the roller nip and during fixing.

Figure 10A:
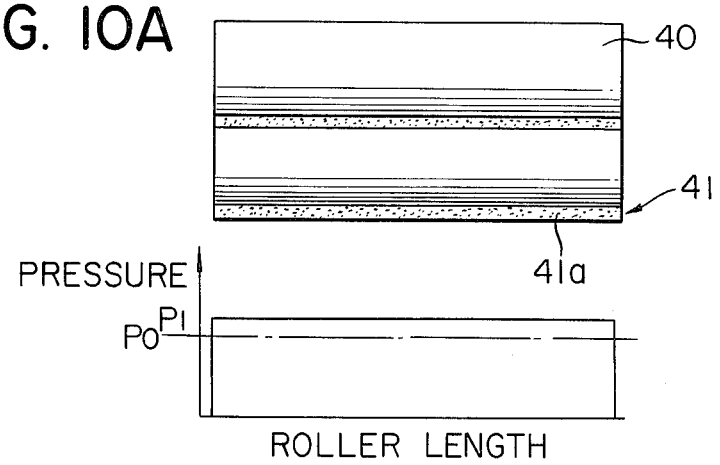
FIGS. 10A to 10C illustrate the pressure distribution thereof.
Figure 10B:
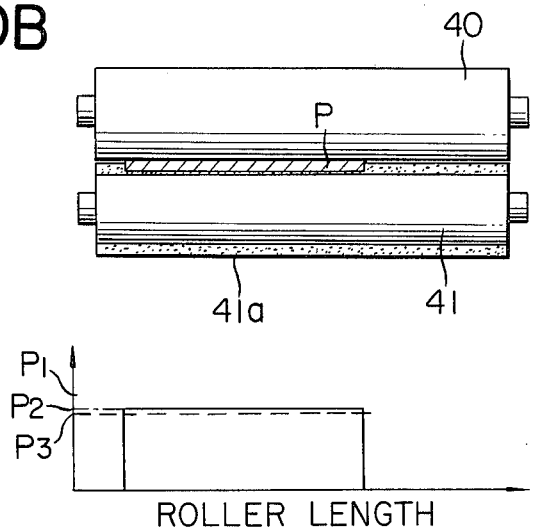
Figure 10C:
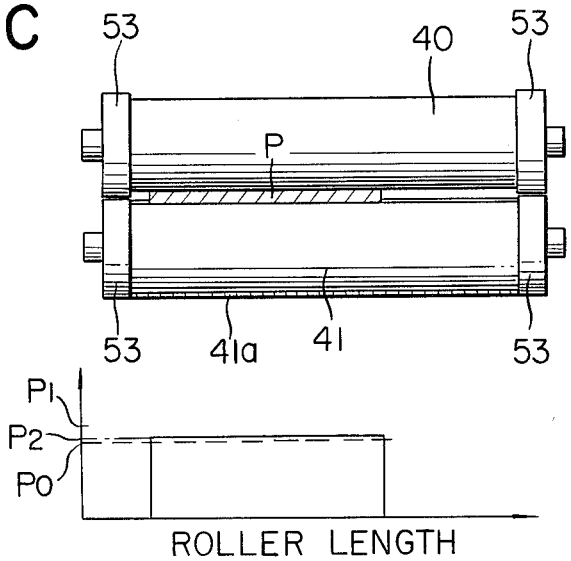

In either of FIG. 9B embodiment and FIG. 9C embodiment, it is desirable that support member fixing means be interlocked with image fixing member such as fixing roller to keep the image fixing member in a determined fixed state during fixing. FIGS. 10A and 10B illustrate the distribution of the nip pressure in the embodiment shown in FIG. 9A at non-fixing time and at fixing time respectively. FIG. 10C illustrates the distribution of the nip pressure in another embodiment where both of the upper and lower rollers 40 and 41 are provided with franges 53 at both ends of the roller. The franges 57 serve to maintain a determined gap between the upper and lower rollers.

In FIG. 10, P0 indicates the pressure level normally required to fix a developed image on a transfer material P. P1 indicates the applied pressure level at non-fixing time and P2 does that at fixing time (in case of FIG. 10C the pressure P1 is that obtained at the both ends). For FIGS. 10A and 10B, a rigid metal roller plated with chrome has been used as the fixing roller 40. As the pressing roller 41 there has been used a metal roller covered with an elastic layer 41*a*.

For FIG. 10C, there has been used, as the fixing roller 40, a metal roller having steel franges 53 at both ends and a working middle part plated with chrome. As the pressing roller 41 there has been used a metal roller having steel franges 53 and a working middle part covered with an elastic layer 41*a*. In both of the rollers 40 and 41, the working area used for fixing is smaller in diameter than the end frange portions.

The elastic layer 41 has been formed of urethan rubber (hardness: 95 degrees). The layer thickness was 0.5 mm. Of course, other materials such as cotton and various resins such as high density polyethylene may be used to form the elastic layer.

The embodiment above described with reference to FIGS. 9 and 10 improves the uniformity of applied pressure to the transfer material P, which will be described in detail hereinafter.

In the embodiment, the upper and lower support members on the side near the guide line L are fixed together by the bolt 48.

When a transfer material having a large width passes between the rollers 40 and 41, a uniform pressure is applied to the transfer material P by the bolt 48 and the spring 47 at the both ends of the rollers. Even when a narrow transfer material passes through between the rollers along the guide line L, the bolt 48 on the guide line (transporting reference) side keeps the gap between the two rollers within a limited range. This prevents one of the rollers from being shifted up by the transfer material and therefore prevents any irregularity of applied pressure otherwise caused by shifting of the roller. Also the elastic layer 41*a* applied on at least one of the rollers provides a considerably large allowance for the thickness of transfer material although the gap between the rollers 40 and 41 is substantially fixed at a constant value by the fixing member (bolt 48).

When the difference in thickness between transfer materials is large, it is recommendable that the gap set by the fixing member be adjustable.

Although not shown in the drawing, the pressing mechanism may be fixed on both sides of the roller as a modification of the above embodiment (employing either of FIG. 9B embodiment and FIG. 9C embodiment). By this modification, also good fixing can be performed.

According to the above embodiment, improvements in uniformity of applied pressured to various transfer sheets having different thickness and width can be attained in a very simple manner by keeping the pressing mechanism in a fixed position on the guide line side or the sheet separation side and by providing an elastic layer on the roller on the side not contacted by toner image on the transfer material.

Figure 11:
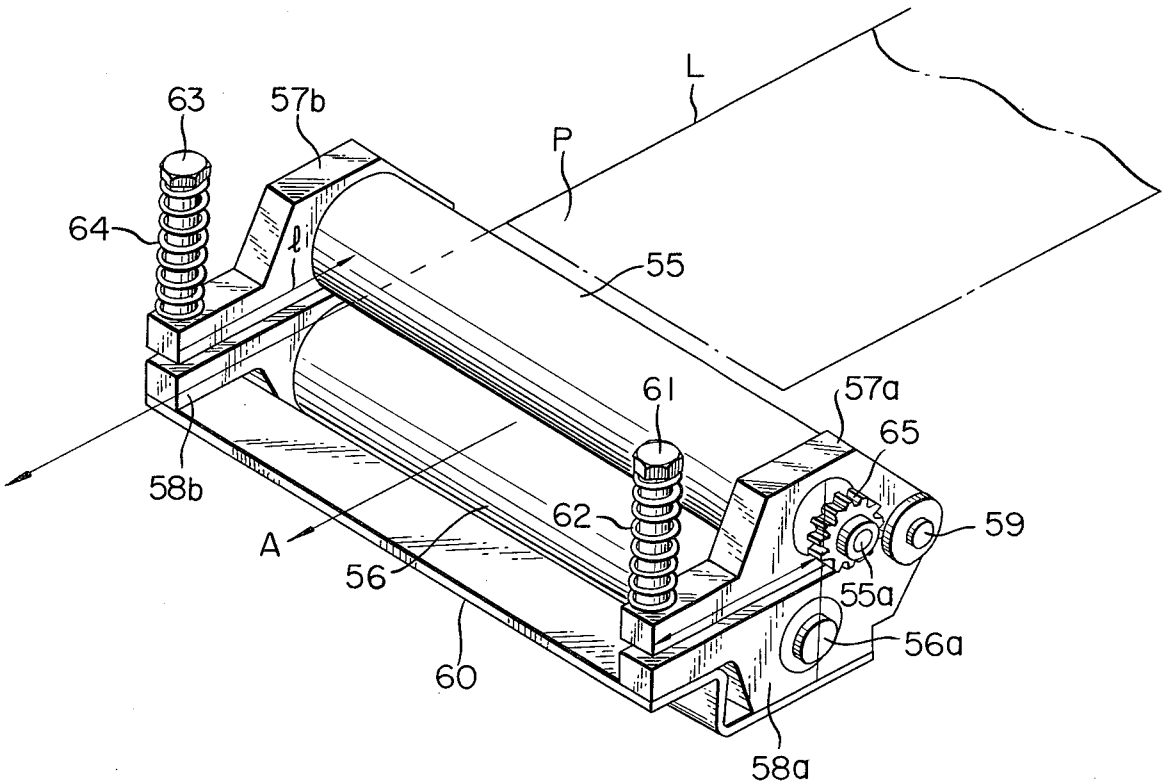
FIGS. 11, 12, 13 and 14 are perspective views showing other embodiments of the invention.

FIG. 11 shows a further embodiment of the invention.

In FIG. 11, two rollers made of metal are in contact with each other under pressure. The upper roller 55 is a fixing roller and the lower roller 56 is a pressure roller. Like the above embodiments, the upper and lower rollers 55 and 56 are supported by support members 57*a*, 57*b* and 58*a*, 58*b* on the both ends of the rollers. Again, the upper and lower support members 57*a·b*, 58*a·b* are joined by a shaft 59 at their one end of opening and closing about the shaft. 60 is a connection plate between the lower support members 58*a* and and 58*b*. 61 is a bolt provided at the free end part of the upper support member 57*a*. The bolt 61 is inserted into a through-hole provided in the free end part of the support member 57*a*. The shank of the bolt 61 is further screwed in the lower support member 58*a* (or inserted in the lower support member passing through also a through-hole). The lower end of the shank is fastened by a nut. Between the head of the bolt 61 and the upper support member 57*a* there is disposed a compression spring 62 whose spring constant is K. On the opposite side to the bolt 61 there is provided a similar bolt 63. The bolt 63 is inserted into the upper and lower support members 57*b* and 58*b* and fixed thereto in the same manner as above. Between the head of the bolt 63 and the upper support member 57*b* there is disposed also a compression spring 64. The spring constant of this spring 64 is K1 which is larger than the spring constant K of the spring 61. The lower end of the bolt 63 is fastened in the same manner as the above mentioned bolt 61.

The two bolts 61 and 63 are equally spaced from the supporting point of the roller 55 by a distance l. The bolts 61 and 63 project upright from the corresponding support members 57*a* and 57*b* by a certain determined length which determines the whole length of the springs 62 and 64. In case that the support members 57*a* and 57*b* have been made of the same material and have the same shape, the length of the projection of the bolts is so determined as to hold the following relation at non-fixing time:

(spring constant K of spring 62)×(displacement from natural length ΔxK)=(spring constant K1 of spring 64)×(displacement from natural length ΔxK1)

The transfer material P bearing a toner image enters the nip between the upper and lower rollers 55 and 56 while the transfer material P being moved along the guide line L (on the side of bolt 63). To drive the upper roller 55 a driving force is transmitted to the roller shaft 55*a* from a driving source such as motor not shown through a gear 65 mounted on the roller shaft 55*a*. The lower roller 56 rotates following the rotation of the upper roller 55. The rollers 55 and 56 fix the toner image on the transfer material by the nip pressure and conveys it in the direction of arrow A. 56*a* is the roller shaft of the lower roller 56.

Conventionally, fixing has been carried out while applying the same pressure on the both sides of the roller and the fixing apparatus has been so designed as to produce uniform distribution of the applied pressure to the transfer material only when the transfer material is of maximum size. Therefore, if the transfer material P has a different size from the maximum and the same pressure is applied on the both sides of the roller, then the upper roller lifts up excessively on one side of the roller. Let Δx be this excessive lift of roller and ΔF be the force applied to the compression spring on the lifted side. Then, $\Delta F = k\Delta x$ wherein k is compression spring constant.

As previously noted, in the present embodiment of the invention, the spring constant K1 of the spring provided on the guide line side is larger than the spring constant K of the spring on the other side. Further, setting of the initial pressure is so made as to satisfy the relation, $F = K\Delta xk = K1\Delta xk1$ = (spring constance × initial spring displacement) wherein F is the force applied to the spring 62 or 64. Since $K1 > K$, $\Delta xk > \Delta xk1$.

In the conventional arrangement, $k = K1 = K$. Therefore, the excess lift $\Delta x = \Delta x'$ in the conventional arrangement is:

$$\Delta x' = \Delta F/K \text{ because } \Delta F = k\Delta x.$$

In contrast, in the above embodiment of the invention, $k = K1 > K$. The excess lift (compression of spring having constant K1) $\Delta x = \Delta x''$ becomes:

$$\Delta x'' = \Delta F/K1 < \Delta F/K = \Delta x'$$

Since the displacement $\Delta x''$ in the above embodiment is smaller than that in the conventional one ($\Delta x'' < \Delta x'$), the present embodiment prevents irregularity of pressure distribution at fixing. Therefore, it is possible to attain good fixing with substantially uniform pressure throughout the whole area of the transfer material.

The effect of the embodiment of the invention is demonstrated also by the following experimental example:

A toner image was fixed on a relatively thick and small size transfer material by the fixing apparatus of the above embodiment. The size of the used transfer material was nearly the same as that of a post card. The length of the upper and lower rollers 55 and 56 was 24 cm. The pressing mechanism was composed of a spring (spring 64) on the guide line side and a spring (spring 62) on the opposite side. The spring constant of the spring 64 was 30 kg/mm and that of the spring was 10 kg/mm. By this pressing mechanism there was applied a line pressure 15 kg/mm. The transfer material was one side guided to pass through between the roller along the guide line. The toner image was fixed uniformly on all area of the transfer material and a good fixed image was obtained.

For the purpose of comparison, fixing was conducted on the same post card size of transfer material by a conventional pressing mechanism in which the springs on the both sides were of the same spring constant of 10 kg/mm. The toner image was fixed only on a part of the transfer material. On the remaining part of the transfer material the toner image remained not fixed because of irregularity of the applied pressure to the transfer material.

Figure 12:
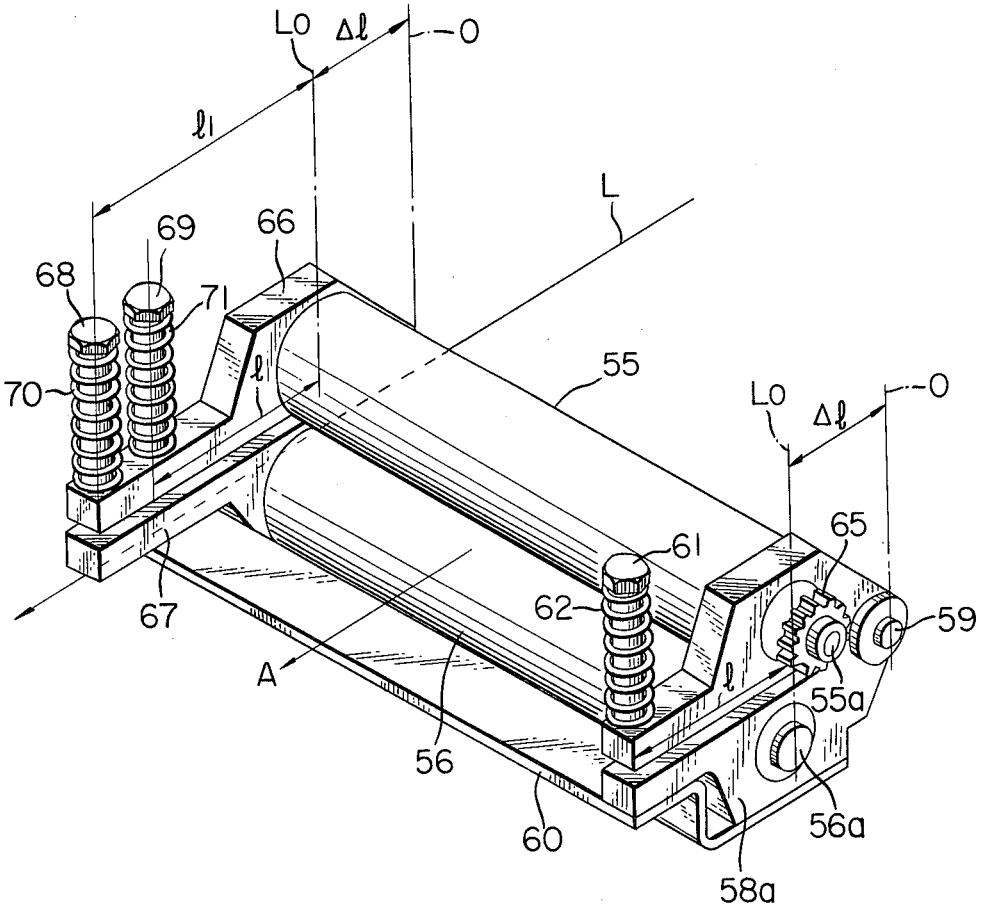

FIG. 12 shows a modification of the above embodiment shown in FIG. 11.

In this modification, the support members 57*b* and 58*b* in the above embodiment are replaced by support members 66 and 67 which are pivotally supported by a shaft 59. On the opposite side to the shaft 59, that is, on the free end side of the support members 66 and 67 there are provided two bolts 68 and 69. To receive the bolts, the support members 66 and 67 have two through-holes. The distance between the center of one through-hole and the roller shaft supporting point Lo measures l, and that between the center of another hole and the supporting point Lo measures l1 (l1>l). Disposed between the head of the bolt 68 and the upper support member 66 is a compression spring 70 of spring constant K2 mounted for interlocking motion and with initial displacement ΔxK2. Disposed between the head of the bolt 69 and the support member 66 is a compression spring 71 having a spring constant K3 mounted for interlocking motion and with initial displacement ΔxK3. The support members 57*a* and 58*a*, and the bolt 61 and spring 62 on the opposite side correspond to those of the above embodiment.

The force F applied by these compression springs 62, 70 and 71 on the right-hand side and on the left-hand side of the roller shaft is:

$$F = K2\Delta xk2 + K3\Delta xk3 \geqq K\Delta xk1$$

Therefore, the compression springs 70 and 71 ($\Delta xk2 \geqq 0$, $\Delta xk3 \geqq 0$) bear in common the determined force F by the compression spring 62. So long as the values of initial displacement Δxk2 and Δxk3 are both positive, both of the compression springs 70 and 71 are always active. Accordingly, such excess displacement as produced in the conventional arrangement is absorbed by these two compression springs 70 and 71. Therefore it is assured that substantially uniform pressure can be applied to any size transfer material P.

It is possible to set one of the initial displacement Δxk2 and Δxk3 to zero (0) and dispose the compression spring always in contact with the support member 66 (as shown in the drawing) which compression spring remains in natural length under the state in which the determined pressure can be applied to between the rollers 55 and 56. Also, one of the springs 70 and 71 may be such compression spring which is in the state of natural length during non-fixing with no transfer material entering the roller nip and which gets in the compressed state when a transfer material has entered the nip. Also, it is possible to provide only the first compression spring 70 at the distance l1 while omitting the second compression spring 71. In this case, the spring constant K2 and initial displacement Δxk2 of the spring 70 are so determined as to hold the following relation to the compression spring 62 on the opposite side (its spring constant: K, initial displacement: $\Delta x_k$ and distance: l(l<l1):

$$K2\Delta xk2 \geqq k\Delta xk,\ l1K2 > lK$$

By doing so, adequate uniformity of pressure can be attained. As seen from the above relation formula, the compression spring 70 has a larger compression spring energy to the relative displacement between the rollers 55 and 56 and therefore it acts on the rollers as to equalize them.

The distance l, l1 is preferably determined using the center line O of the axis 59 as the base. The reason for this is that the above relation is not always applicable to the case where the rollers 55 and 56 are of the intersection type. In the above embodiments, the distance between the center line O and the center line Lo has been shown to be the same, Δl on the both sides of the rollers. In any case, the use of compression spring(s) as shown in the above embodiments improves the uniformity of applied pressure to the transfer material. The compression spring is in the non-compressed state at least during non-fixing and can follow the movement of the support member 66. It reacts to any excess motion of the support member at once and restrains the excess motion. Accordingly, at all of times during which the transfer material is passing through between the rollers, the nip pressure is applied to the transfer material uniformly and in a more stable manner.

Figure 13:
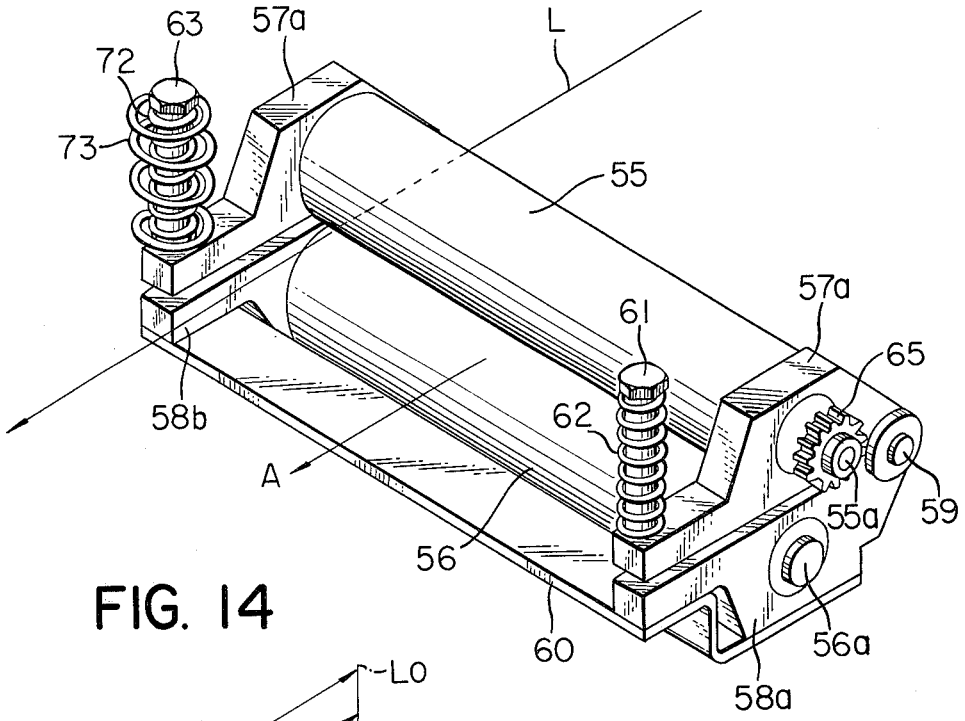

FIG. 13 shows another embodiment of the invention wherein the arrangement shown in FIG. 11 is used as basic arrangement of the fixing apparatus.

In this embodiment, the feature of two compression springs provided on the guide line side as shown in FIG. 12 is incorporated into the fixing apparatus. But, the two bolts 68 and 69 are replaced by single particular bolt 63 in this embodiment. Between the head of the bolt 63 and the upper support member 57*a* there are disposed two different compression springs 72 aand 73. Of these two springs the first compression spring 72 has a spring constant of K1 and the same initial displacement as the initial displacement, Δxk1 of the spring 62 on the opposite side. The second compression spring 73 has a spring constant of K4 (K4>K1). Its initial displacement ΔxK4 is zero (namely, natural length). The two compression springs 72 and 73 are concentrically disposed around the bolt 63 with the first spring 72 being inside spaced from the second spring 73.

For any size of transfer material entering the nip between the rollers 55 and 56 along the guide line L, a determined pressure is applied to the transfer material by the compression springs 62 and 72. At this time, the compression spring 73 serves to limit the gap between the rollers within a proper range and prevent the gap from being excessively broadened.

This embodiment has a merit that the manufacturing steps required for making the apparatus can be decreased as compared with the previously shown embodiments. The fixing apparatus according to this embodiment is simple in construction and low in manufacturing cost.

Figure 14:
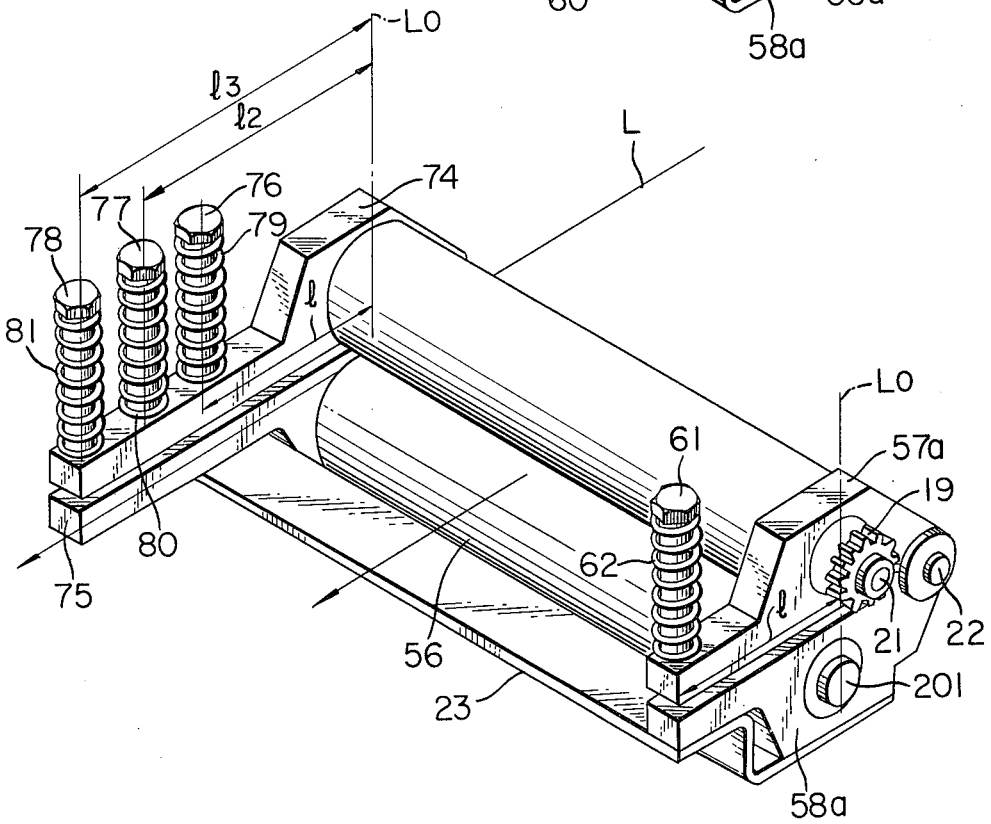

FIG. 14 shows a further embodiment of the invention. In this embodiment, the support members 74 and 75 on the side of guide line L are longer than the support members 57*a* and 58*a* on the opposite side. On the free end part of the longer support members there are arranged three bolts 76, 77 and 78 passing through the support members 74 and 75. The lower end of each the bolt is fixed by a nut like the above described bolts 61 and 63. The working length of each the bolt is suitably adjusted by the nut. Around these bolts 76, 77, 78 there are disposed compression springs 79, 80, 81 confined between the heads of the bolts and the upper support member 74 respectively. The spring constants of the compression springs 79, 80 and 81 are K5, K6 and K7 respectively. The compression spring 62 disposed between the head of the bolt 61 and the upper support member 57*a* on the opposite side has a spring constant of K1 and its initial displacement is ΔxK1.

For setting these compression springs 79, 80, 81 on the side of L there may be used several different methods only three examples of which will be described hereinafter for the purpose of illustration.

EXAMPLE 1

The center of the bolt 78 is distant from the roller supporting point Lo on the side of guide line L by a distance l3 which is larger than the distance l between the bolt 61 and the roller supporting point Lo on the opposite side. Thus, the spring working point on the side of L and the spring working point on the opposite side and different from each other. Further, the working force by the compression spring 81 is larger than that of the compression spring 62 on the opposite side. In case of this example, a good fixing effect can be attained even when K1 and K7 are the same value (including the case wherein K1<K7 but K1l<K7l3 at working time). A further improved fixing effect can be obtaining by setting the spring constant K7 to a value larger than K1. In this case, other bolts 76 and 77 with compression springs 79 and 80 may be omitted. However, provision of bolts 76, 77 and springs 79, 80 has an advantage that the force can be dispersed. The effect to uniformalize the nip pressure to transfer material increases with increasing of spring constant or rate. However, the use of larger spring constant has a disadvantage that the applied pressure is greatly changed by a very small displacement. According to the setting method described in this example, the desired effect is attained by changing not spring rate but working distance between spring and roller. The effect obtained by changing the working distance is substantially equivalent to that as obtained by changing spring constant. Therefore it is not necessary to use a spring having large spring constant. This makes easy the pressure setting of springs in the pressing mechanism.

EXAMPLE 2

The middle compression spring 80 at distance l2 from Lo (or spring 81 at distance l3) is so set as to correspond to the compression spring 62 on the opposite side. More particularly, the compression spring 80 has the same spring constant, initial displacement and distance l as the compression spring 62 has. Other two compression springs 79 and 81 have larger spring constants K5 and K7 than that of the compression springs 62 and 80. Further, compression springs 79 and 81 are set in natural length so as to make their initial displacement zero.

In this example, an excess of gap distance between the rollers 55 and 56 is absorbed by the compression springs 79 and 81 thereby improving the stability of fixing for different transfer materials having different width and thickness. Also, the durability of the pressing mechanism can be improved by it.

EXAMPLE 3

All of the compression springs 79, 80 and 81 have positive initial displacement ΔxK5, ΔxK6 and ΔxK7. All the pressing force and displacement are distributed to and divided among the three compression springs 79, 80 and 81 so that they take their own share. Preferably the total pressure and the total spring constant of the side of the support member 74 are equal to or larger than those on the side of the support member 57*a*. One of the important effects attainable by this arrangement is that the spring 81 at the largest distance l3 from the center line Lo can effectively serve to equalize the applied pressure and the spring 79 at the shortest distance l can serve to absorb any abrupt change of pressure caused by the entrance of transfer material between the rollers.

As readily understood from the above examples, the embodiments eliminate the irregularity of pressure distribution along the nip between the two fixing rollers as will be caused by the one-sided transfer material passing through the nip. The above embodiments enable to obtain a simple construction. A determined fixing pressure can be obtained for different transfer materials having different sizes without fail. Therefore, always good fixing can be attained by the embodiments.

Pressure applying means used in the invention is never limited to spring only. Various other pressure applying means may be used in the invention. For example, leaf spring, elastic body, oil pressure and air pressure can be used. Rollers shown in the above may be formed using various materials. The rollers can be formed with or without any elastic covering member. When the rollers are metal rollers, a particularly good result can be obtained. The present invention is applicable to all those apparatus which include any mechanism for applying pressure. According to the invention, a determined pressure can be applied uniformly throughout the whole area of a sheet material whatever size it may be. Therefore, a particular advantage can be obtained when the present invention is applied to a pressure fixing apparatus. Since a necessary and sufficient fixing pressure can be applied uniformly to the whole unfixed, developed image on an image bearing material, a high quality fixed image can be obtained according to the invention. In addition to the embodiments shown in FIGS. 11 to 14, therefore, all of embodiments as expressed by the following (1) to (3) are included in the scope of the invention:

(1) A pressure fixing apparatus characterized in that pressure applying means are provided on the both end parts of roller to apply pressure between the first and second rollers and that when a toner image bearing member having a maximum roller width passes through between the rollers, a pressure larger than the normal pressure required for fixing is applied to the image bearing member and at the same time the stress to the roller lift displacement on the other end or on the separation side of the image bearing member relative to the rollers is larger than that on the other side.

(2) A pressure fixing apparatus as set forth in (1) which is characterized in that said pressure applying means are springs provided on the both end parts of the roller and the spring provided on the separation side has a larger spring constant than that of the spring on the other side.

(3) A pressure fixing apparatus as set forth in (1) or (2) which is characterized in that on the separation side there are provided a plural number of springs the spring constant in total of which is larger than the spring constant of the spring on the other side.

Figure 15:
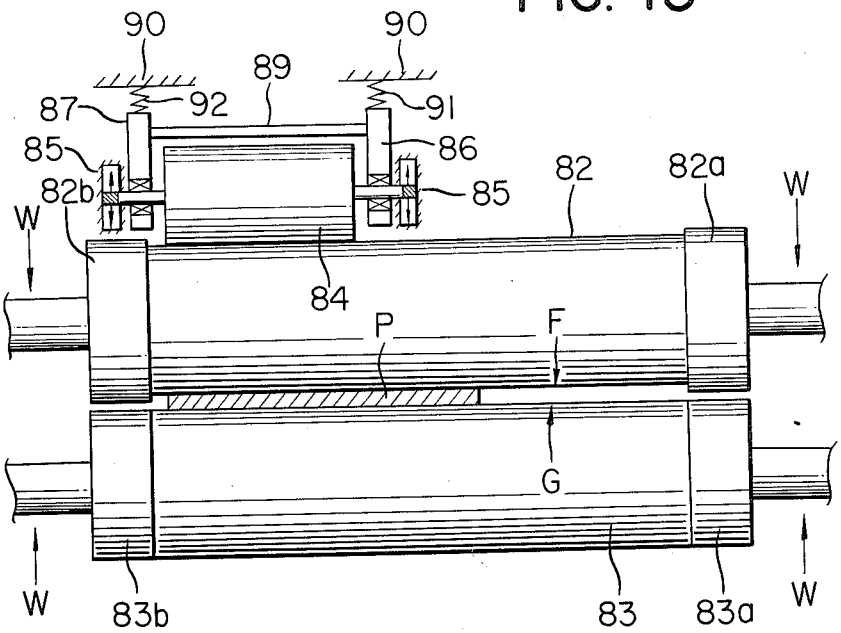
FIGS. 15 and 16 are front views of further embodiments of the invention.
Figure 16:
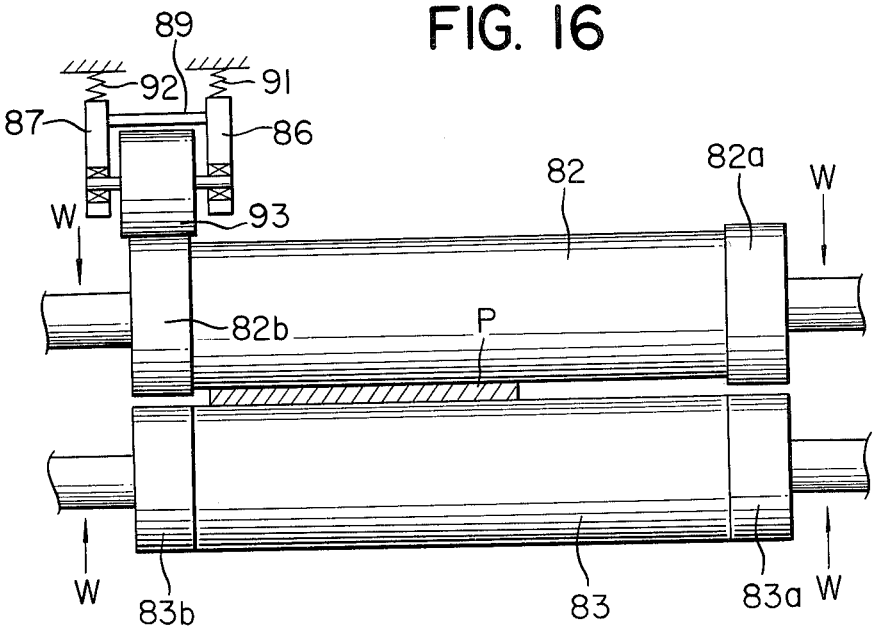

FIGS. 15 and 16 show further embodiments of the invention.

Designated by 82 is a fixing roller which is contacted by a toner image on a transfer material P. The fixing roller 82 has two larger diameter end portions 82*a* and 82*b* and a smaller diameter working part F. The difference in diameter between the end portion and the working part is about 20 microns smaller than the thickness of the transfer material P. 83 is a pressure roller of uniform diameter. The pressure roller 83 has also two end portions 83*a* and 83*b* and a working part G. The end portions 83*a*, 83*b* of the pressure roller 83 and the end portions 82*a*, 82*b* of the fixing roller 82 come into contact with each other under pressure. The working part F of the fixing roller 82 and the working part G of the pressure roller 83 remain always spaced from each other.

A driving power is transmitted to one of the rollers 82 and 83 to drive it into rotation about its rotation axis supported by a known bearing. Another roller 82 or 83 also rotatably supported by a bearing rotates following the rotation of the power driven roller or through a gear transmission. On the both sides of the rollers there are provided pressing mechanisms, one on one side and another on the opposite side (not shown). By the pressing mechanisms, the same load W is applied to the both ends of the rollers 82, 83. The load W is of such level sufficient enough to fix the toner image onto the transfer material P.

In the embodiment shown in FIG. 15, both of the rollers 82 and 83 are rigid rollers. 84 is a pressing roller in contact with the working area F of the fixing roller 82. The pressing roller 84 is disposed on the side opposite (180°) to the pressure roller 83. The pressing roller 84 is supported at a part indicated by 85 within the image forming apparatus. The roller 84 is movable up and down in the same direction as the load W. Bearing members 86 and 87 supporting the pressing roller for rotation are connected each other by a connection member 89. The bearing members 86 and 87 are under the action of compression springs 91 and 92 respectively. One end of each the compression spring is anchored to a stationary part 90 in the apparatus.

In the shown embodiment, the compression spring 92 (on this side the gap between the two rollers 82 and 83 has a tendency to open wider) has a larger spring constant K8 than the spring constant K7 of the compression spring 91. Under the action of these springs 91 and 92 the nip distance between the two rollers 82 and 83 at the working area is kept constant during fixing of toner image on the transfer material P. Therefore, the fixing pressure can be applied to the transfer material P while making full and effective use of the pressing forces of the pressing mechanisms on the both sides of the rollers. This assures always good fixing for different transfer materials having different thickness and width. Further, since the pressing roller 84 is pressing the surface of the fixing roller 82 toward the pressure roller 83, any flex of the fixing roller 82 can be absorbed by the pressing roller 84 and the fixing roller 82 can be well paralleled to the pressure roller 83 by it.

It is preferable to make the pressing roller 84 from the same or similar material to the material of the fixing roller 82. However, the two rollers may be made of different materials provided that the fixing roller is not damaged by the pressing roller.

In the above embodiment, the compression springs 91 and 92 are different in spring constant. However, it is to be understood that other arrangements of pressing roller 84 may be used for the same purpose. The thing essential is that the force applied to the both ends of the fixing roller 82 should be suitably weighted, as a whole, on the guide line side of the transfer material P (on the side on which the roller gap is apt to open wider).

FIG. 16 shows a modification of the above embodiment.

In this modification, a pressing roller 93 is in contact with one end part 82*b* of the fixing roller 82 on the side of transfer material guide line. Therefore, in this modification, the pressing roller 93 does not contact with the working area of the fixing roller 82 unlike the pressing roller 84 in FIG. 15. This provides a wider selection range of material for the fixing roller 82. Roller end parts 82*a*, 82*b* and 83*a*, 83*b* and the pressing roller 93 itself are preferably made of abrasion resistable material. This embodiment has an advantage that it does not give any large load on the rotation axes of the rollers 82 and 83 and that the pressing roller 93 does not wear the working area of the fixing roller. This has an effect to improve the durability of the apparatus. Further, in this modification, the spring constants K7 and K8 of the springs 91 and 92 may be the same or different. The width of the pressing roller 93 may be equal to or smaller than that of the roller end portion 82*b*.

According to the embodiments shown in FIGS. 15 and 16, application of sufficient fixing pressure to the toner image can be attained by making the applied pressure on one side different from the applied pressure on the opposite side. Therefore, the present invention includes all other embodiments functionally equivalent to the above shown embodiments.

While the present invention has been shown and described particularly in connection with pressure fixing apparatus it is to be understood that the present invention is applicable also to thermal fixing apparatus.

As will be understood from the foregoing, the present invention generally relates to fixing apparatus of the type in which a toner image bearing member is guided into the nip between a pair of rotary members and the toner image is fixed onto the bearing member by the nip pressure. The fixing apparatus of the invention is characterized by the provision of means for limiting the inter-axis distance between the rotary members within a certain determined range. By this feature the two rotary members are prevented from being spaced from each other too much over the limit even when the toner image bearing member passes through an asymmetric area of the nip between the rotary members. Thus, there is obtained uniform distribution of applied pressure to the toner image bearing member in the axial direction of the rotary members.

What is claimed is:

1. A fixing apparatus of the type in which a nip pressure is applied to a toner image bearing member between a pair of rotary members to fix the toner image onto the bearing member, said fixing apparatus comprising:

a first rotary member;

a second rotary member disposed to nip a toner image bearing member between said first and second rotary members;

support means for rotatably supporting said rotary members;

a pressing means for applying a pressing force between said first and second rotary members; and limiting means, which, at least when said toner image bearing member enters between said first and second rotary members, act on said support means independently from said pressing means for restraining the inter-axis distance between said two rotary members from increasing more than a predetermined value.

2. A fixing apparatus according to claim 1, wherein said limiting means acts on the side of toner image bearing member transporting reference of the supporting means.

3. A fixing apparatus according to claim 1 or 2, wherein said limiting member is formed of a rigid member. means 4. A fixing apparatus according to claim 3, wherein said limiting means is in the form of U character.

5. A fixing apparatus according to claim 1, wherein said limiting means adjustably restrains the inter-axis distance between said two rotary members.

6. A fixing apparatus of the type in which a nip pressure is applied to a toner image bearing member between a pair of rotary members to fix the toner image onto the bearing member, said fixing apparatus comprising:

a first rotary member;

a second rotary member disposed to nip a toner image bearing member between said first and second rotary members;

a first pressing means acting, at a transporting reference side of the toner image bearing member, on said first and second rotary members; and a second pressing means acting on the opposite side of said first and second rotary members; wherein when said toner image bearing member enters between said first and second rotary members, the acting force of said first pressing means is larger than that of said second pressing means.

7. A fixing apparatus according to claim 6, wherein said apparatus comprising first support means rotatably supporting said first rotary member and second support means rotatably supporting said second rotary member, and said first pressing means has a fixing member to fix said first and second support means at the side of transporting reference for said toner image bearing member.

8. A fixing apparatus according to claim 6, wherein said first pressing means and second pressing means comprising a compression spring, respectively, and the spring constant of the spring of the first pressing means is larger than that of the spring of the second pressing means.

9. A fixing apparatus according to claim 6, wherein said first pressing means has a plurality of compression springs and said second pressing means has at least one compression spring, the number of springs of the first pressing means being larger than that of the second pressing means.

10. A fixing apparatus according to claim 6, wherein said first and second pressing means comprise compression springs, respectively, and the force on the rotary members by said first pressing means is larger than that of the second pressing means.

11. A fixing apparatus according to claim 6, wherein said first pressing means has a compression spring, which is in its natural length in non-fixing state and is compressed when said toner image bearing member enters between said two rotary members.

12. A fixing apparatus according to claim 6, wherein said first pressing means comprises an assembly consisting of pressing roller acting on said first rotary member and a compression spring urging the pressing roller to contact with said first rotary member.

13. A fixing apparatus according to claim 12, wherein said first rotary member has both ends of which diameters being somewhat larger than the diameter of the roller within fixing operation region, and these both ends and said second rotary member are in the closely contacting state, and the fixing operation regions of said first rotary member and second rotary member, respectively, form a clearance therebetween which is less than the thickness of said toner image bearing member.

14. A fixing apparatus according to claim 13, wherein the pressing roller of said assembly is arranged always to contact the first rotary member in its fixing operation region at the side of transporting reference for said toner image bearing member.

15. A fixing apparatus according to claim 13, wherein the pressing roller of said assembly is arranged always to contact the first rotary member at its end of the side of transporting reference for said toner image bearing member.

* * * * *

UNITED STATES PATENT AND TRADEMARK OFFICE

CERTIFICATE OF CORRECTION

PATENT NO. : 4,440,486

DATED : April 3, 1984

INVENTOR(S) : KAZUO ISAKA, ET AL.

It is certified that error appears in the above-identified patent and that said Letters Patent is hereby corrected as shown below:

Column 2, line 38, "axially" should read --axial--.

Column 3, line 8, "embodiment" should read --embodiments--.

Column 4, line 30, "member" should read --members--.

Column 5, line 4, "sanwiched" should read --sandwiched--;
line 37, "transter" should read --transfer--.

Column 6, line 9, change "of" to --or by--;
line 12, change "lmiting" to --limiting--;
line 18, change "emboidment" to --embodiment--.

Column 7, line 17, insert --of-- after "independently".

Column 8, line 48, "provision" should read --Provision--.

Column 9, line 52, "Bt" should read --By--.

Column 10, line 43, "urethan" should read --urethane--.

Column 12, line 28, delete period after "64"; "Since" should read --since--.
line 61, "roller" should read --rollers--.

Column 14, line 31, "aand" should read --and--;
line 60, delete "the" after "each";
line 62, delete "the" after "each".

Column 15, line 16, "and" should read --are--.

UNITED STATES PATENT AND TRADEMARK OFFICE

CERTIFICATE OF CORRECTION

PATENT NO. : 4,440,486

DATED : April 3, 1984

INVENTOR(S) : KAZUO ISAKA, ET AL.

It is certified that error appears in the above-identified patent and that said Letters Patent is hereby corrected as shown below:

Column 17, line 32, insert --to-- after "connected";
line 36, delete "the" after "each".

Column 19, lines 6 - 7, Claim 3, delete "member."; insert period after "means".

Signed and Sealed this

*Fourth* Day of *December 1984*

[SEAL]

*Attest:*

GERALD J. MOSSINGHOFF

*Attesting Officer*

*Commissioner of Patents and Trademarks*